US005370061A

United States Patent [19]

Kilpatrick et al.

[11] Patent Number: 5,370,061

[45] Date of Patent: Dec. 6, 1994

[54] PALLET HAVING NOTCHED STRINGER AND NOTCHED BRACE

[75] Inventors: Ted D. Kilpatrick, Ponte Verde, Fla.; Arthur M. Wagner, Geneva, Ill.

[73] Assignee: Gate Pallet Systems, Inc., Crown Point, Ind.

[21] Appl. No.: 74,942

[22] Filed: Jun. 10, 1993

[51] Int. Cl.[5] ..... B65D 19/00

[52] U.S. Cl. ..... 108/51.3

[58] Field of Search ..... 108/51.3, 51.1, 56.1, 108/56.3

[56] References Cited

U.S. PATENT DOCUMENTS

| | | | |
|---|---|---|---|
| 2,446,914 | 8/1948 | Fallert et al. | 108/51.3 |
| 2,728,545 | 12/1955 | Hermitage | 108/51.3 |
| 2,955,791 | 2/1957 | George . | |
| 3,131,656 | 5/1964 | Houle . | |
| 3,683,822 | 8/1972 | Roberts et al. . | |
| 4,792,325 | 12/1988 | Schmidtke | 108/51.3 X |
| 4,867,074 | 9/1989 | Quasnick | 108/51.3 |
| 4,979,446 | 12/1990 | Winebarger | 108/51.3 |
| 5,001,991 | 3/1991 | Smith . | |

FOREIGN PATENT DOCUMENTS

| | | |
|---|---|---|
| 1250352 | 4/1968 | Germany . |
| 996516 | 7/1965 | United Kingdom . |

*Primary Examiner*—Jose V. Chen

*Attorney, Agent, or Firm*—Dressler, Goldsmith, Shore & Milnamow, Ltd.

[57] ABSTRACT

A pallet comprises at least one relatively long, longitudinally extending stringer folded from a single sheet of corrugated paperboard material of a given cross-section, preferably trapezoidal, and two relatively short, transversely extending braces, each folded from a single sheet of corrugated paperboard of a similar cross-section, preferably inverted. The stringer has notches receiving portions of the braces. Each brace has a notch receiving a portion of the stringer. The notches interfit with each other and are dimensioned so that the stringer and the braces are coplanar at their upper and lower edges. The stringer and the braces are secured adhesively to each other at the interengaging notches. In one contemplated embodiment, plural decking members are employed. In other contemplated embodiments, an upper sheet and a lower sheet are employed. In certain contemplated embodiments, the stringer with the braces is a middle stringer between two outer stringers.

18 Claims, 1 Drawing Sheet

PALLET HAVING NOTCHED STRINGER AND NOTCHED BRACE

TECHNICAL FIELD OF THE INVENTION

This invention pertains to a pallet that may be predominantly made of paperboard material, such as corrugated paperboard. According to this invention, at least one longitudinally extending stringer and at least one transversely extending brace are made from folded pieces of paperboard material and are employed in a novel combination, in which a notch in the stringer interengages with a notch in the brace with the notches dimensioned so that the stringer and the brace are substantially coplanar at their upper and lower edges.

BACKGROUND OF THE INVENTION

Usage of shipping pallets made predominantly of corrugated paperboard material is widespread, primarily because of their low cost, recyclability, and cleanliness. Typically, such pallets employ longitudinally extending, transversely spaced stringers, which are made from folded pieces of corrugated paperboard. Such pallets also may employ transversely extending, longitudinally spaced decking members, which also are made from folded pieces of corrugated paperboard. Further, it is known to provide such pallets with upper and lower sheets, which are secured adhesively to the upper and lower edges of the stringers.

As described above, shipping pallets made predominantly of paperboard material, such as corrugated paperboard, are exemplified in Schmidtke U.S. Pat. No. 4,792,325, Quasnick U.S. Pat. No. 4,867,074, and Smith U.S. Pat. No. 5,001,991. Similar pallets made predominantly of corrugated paperboard are available commercially from Gate Pallet Systems, Inc. of Crown Point, Ind., under its PAYLOAD trademark.

Other pallets of related interest are disclosed in Hermitage U.S. Pat. No. 2,728,545, Houle U.S. Pat. No. 3,131,656, Gifford U.S. Pat. No. 3,464,371, Childs U.S. Pat. No. 3,659,534, Roberts U.S. Pat. No. 3,683,822, Melli U.S. Pat. No. 4,563,377, British Patent Specification No. 996,516, German Patent No. 1,250,352, and Swiss Patent No. 512,367.

As disclosed in Smith U.S. Pat. No. 5,001,991, it is known to increase the lateral stability and load-carrying capacity of such a pallet by means of tubular reinforcing pieces, which have slots interengaging with slots in the stringers. It is disclosed therein that tightly wound paper tubing, such as that used for cores for paper rolls, is a suitable material for such pieces.

This invention has resulted from efforts further to increase the lateral stability and load-carrying capacity of such a pallet.

SUMMARY OF THE INVENTION

This invention provides an improved pallet, which may be predominantly made of paperboard material, such as corrugated paperboard. The improved pallet does not require tubular reinforcing pieces to achieve excellent lateral stability and load-carrying capacity.

The improved pallet comprises at least one longitudinally extending stringer folded from a single sheet of paperboard material of a given cross-section, preferably a tapered cross-section, and more preferably a trapezoidal cross-section. The improved pallet also comprises at least one transversely extending brace folded from a single sheet of paperboard material of a similar cross-section. Preferably, the stringer is relatively long, and the brace is relatively short.

The stringer has a notch receiving a portion of the brace. The brace has a notch receiving a portion of the notch. The notches interengage with each other and are dimensioned so that the stringer and the brace are substantially coplanar at their upper and lower edges. The stringer and the brace may be adhesively secured to each other at the interengaging notches.

The brace may be one of two similar braces, which are spaced from each other along the stringer, and which may be located near opposite ends of the stringer. The stringer with the brace may be a middle stringer between two outer stringers, each extending longitudinally and being folded from a single sheet of paperboard material of a similar cross-section. Preferably, if two outer stringers are used, opposite ends of the brace are spaced from the outer stringers.

In one contemplated embodiment, the pallet further comprises a plurality of decking members, which extend transversely through apertures in such outer and middle stringers. In another contemplated embodiment, an upper sheet is secured adhesively to the upper edges of the outer and middle stringers, and a lower sheet is secured adhesively to the lower edges of the outer and middle stringers.

In another contemplated embodiment, which does not require the outer stringers, an upper sheet secured adhesively to the upper edge of the stringer has two side flaps folded downwardly, and a lower sheet secured adhesively to the lower edge of the stringer has two side flaps folded upwardly. The side flaps of the upper and lower sheets overlap at each side of the pallet. The upper sheet and the lower sheet are secured adhesively to each other where the side flaps overlap. It is preferred that opposite ends of the brace are spaced from the overlapping side flaps.

These and other objects, features, and advantages of this invention are evident from the following description of several embodiments of this invention with reference to the accompanying drawings.

DETAILED DESCRIPTION OF ILLUSTRATED EMBODIMENTS

Figure 1:
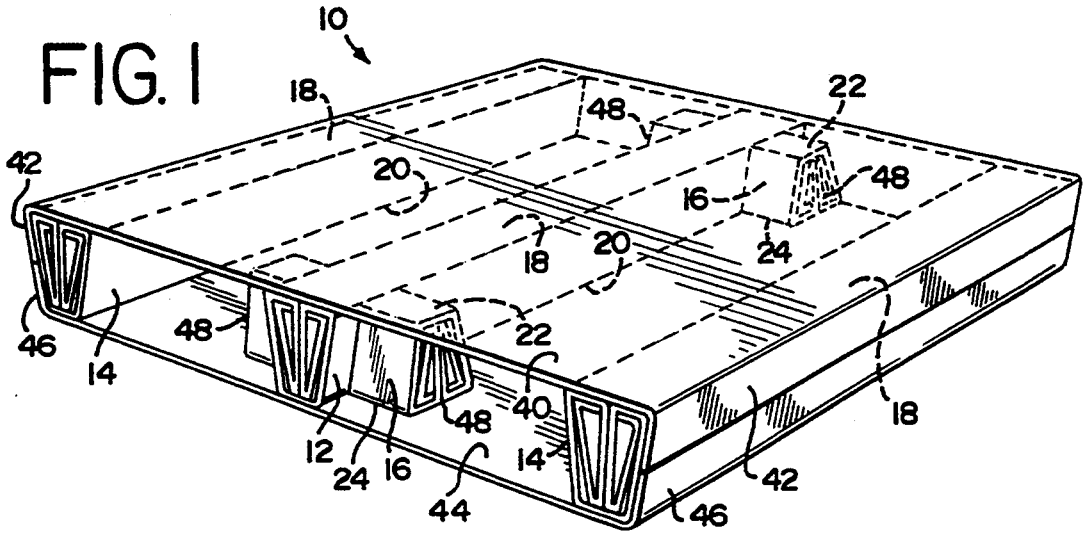
FIG. 1 is a perspective view of a pallet constituting a first embodiment of this invention.

As shown in FIG. 1, a pallet 10 made predominantly of paperboard material constitutes a first embodiment of this invention. The pallet 10 comprises three relatively long, longitudinally extending stringers, namely a middle stringer 12 and two outer stringers 14. The pallet 10 further comprises two relatively short, transversely extending braces 16. The middle stringer 12 has two notches, each interengaging with a notch in a respective one of the braces 16 so as to assemble the middle stringer 12 and the braces 16. The notches in the middle stringer 12 and in the braces 16 are dimensioned so that the middle stringer 12 and the braces 16 are substantially coplanar at their upper and lower edges.

Each of the stringers 12, 14, is folded from a single sheet of paperboard material of a trapezoidal cross-section. The trapezoidal cross-sections of the stringers 12, 14, are substantially identical. Each of the braces 16 is folded from a single sheet of paperboard material of a trapezoidal cross-section, which is substantially identical to the cross-sections of the stringers 12, 14, but which is inverted.

Preferably, as shown, in each of the stringers 12, 14, and in each of the braces 16, eleven panels define a trapezoidal cross-section conforming to the trapezoidal cross-section of the improved stringer illustrated and described in a copending patent application, U.S. patent application Ser. No. 08/038,001 filed Mar. 29, 1993, and assigned commonly herewith. The disclosure of the copending patent application, U.S. patent application Ser. No. 08/038,001, is incorporated herein by reference. As disclosed in the copending patent application, U.S. patent application Ser. No. 08/038,001, certain of the folded panels are secured adhesively to other panels. Alternatively, each of the stringers 12, 14, and each of the braces 16 may conform in their cross-sections to the pallet stringer disclosed in Quasnick U.S. Pat. No. 4,867,074, the disclosure of which also is incorporated herein by reference.

Because of its trapezoidal cross-section, each of the stringers 12, 14, has a relatively wide, substantially planar, upper edge 18 and a relatively narrow, substantially planar, lower edge 20. Because of its inverted, trapezoidal cross-section, each of the braces 16 has a relatively narrow, substantially planar, upper edge 22 and a relatively wide, substantially planar, lower edge 24. The upper edges 18 of the stringers 12, 14, and the upper edges 22 of the braces 16 are substantially coplanar. The lower edges 20 of the stringers 12, 14, and the lower edges 24 of the braces 16 are substantially coplanar.

Figure 4:
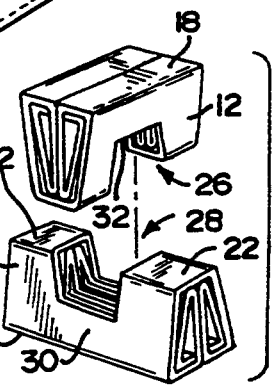
FIG. 4 is a fragmentary, exploded view, which exemplifies how a notch in a stringer interengages with a notch in a brace, in each illustrated embodiment.

One notch 26 of the middle stringer 12 and the notch 28 of one brace 16 are shown in FIG. 4. The notch 26, which flares downwardly, conforms to and receives a lower portion 30 of the brace 16 having the notch 28. The notch 28, which flares upwardly, conforms to and receives an upper portion 32 of the middle stringer 12. The other notch of the middle stringer 12 is similar to the notch 26 and conforms to and receives a lower portion of the other brace 16. The notch of the other brace 16 is similar to the notch 28 and conforms to and receives an upper portion of the middle stringer 12. The notches, which interengage with each other at each of the braces 16, are dimensioned so that the middle stringer 12 and the braces 16 are substantially coplanar at their upper edges 18, 22, and at their lower edges 20, 24. The middle stringer 12 is secured adhesively to the braces 16 at the interengaging notches.

As shown in FIG. 1, the pallet 10 further comprises two substantially planar sheets made from paperboard material, namely an upper sheet 40 having two side flaps 42 folded downwardly and a lower sheet 44 having two side flaps 46 folded upwardly. The side flaps 42 abut the side flaps 46 where the side flaps 42, 46, are folded over the outer panels of the outer stringers 14. The upper sheet 40 is secured adhesively to the upper edges 18 of the stringers 12, 14, and to the upper edges 22 of the braces 16. Also, at the side flaps 42, the upper sheet 40 is secured adhesively to upper portions of the outer panels of the outer stringers 14. The lower sheet 44 is secured adhesively to the lower edges 20 of the stringers 12, 14, and to the lower edges 24 of the braces 16. Also, at the side flaps 46, the lower sheet 44 is secured adhesively to lower portions of the outer panels of the outer stringers 14.

In the pallet 10, the braces are spaced at their opposite ends 48 substantially from the outer stringers 14 so as not to interfere with fork lift blades (not shown) entering the pallet 10 from either longitudinal direction.

Preferably, each of the stringers 12, 14, is folded from a single sheet of double wall, corrugated paperboard, which may be tape-reinforced or fiber-reinforced. Single wall, corrugated paperboard or multi-ply paper may be alternatively used. Preferably, each of the stringers 12, 14, is folded along parallel folding lines extending in a transverse direction relative to flutes of the single sheet of corrugated paperboard.

Preferably, each of the sheets 40, 44, is folded from a double sheet of double wall, corrugated paperboard, which may be tape-reinforced or fiber-reinforced. A single sheet thereof or a sheet of multi-ply paper may be alternatively used.

In the pallet 10, the sheets 40, 44, are similar to the upper and lower sheets of one pallet embodiment disclosed in a copending patent application, U.S. patent application Ser. No. 07/906,356 filed Jun. 30, 1992, and assigned commonly herewith. The disclosure of the copending patent application, U.S. patent application Ser. No. 07/906,356, is incorporated herein by reference. Alternatively, the upper and lower sheets secured to the stringers 12, 14, may be similar to the upper and lower sheets of one of the other embodiments disclosed in the copending patent application, U.S. patent application Ser. No. 07/906,356.

Figure 2:
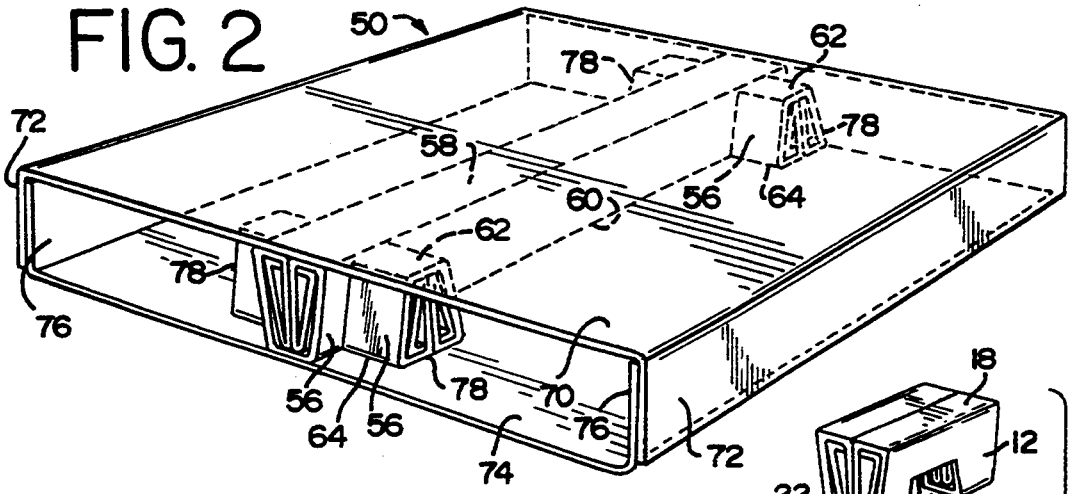
FIG. 2 is a perspective view of a pallet constituting a second embodiment of this invention.

As shown in FIG. 2, a pallet 50 made predominantly of paperboard material constitutes a second embodiment of this invention. The pallet 50 comprises a single relatively long, longitudinally extending stringer 52 and two relatively short, transversely extending braces 56. The single stringer 52 has two notches, each interengaging with a notch in a respective one of the braces 56 so as to assemble the single stringer 52 and the braces 56. The notches in the single stringer 52 and in the braces 56 are dimensioned so that the single stringer 52 and the braces 56 are substantially coplanar at their upper and lower edges.

The single stringer 52 is folded from a single sheet of paperboard material of a trapezoidal cross-section. Each of the braces 56 is folded from a single sheet of paperboard material of a substantially identical, inverted, trapezoidal cross-section.

Preferably, the single stringer 52 and the braces 56 are substantially identical to the middle stringer 12 and the braces 16 of the pallet 10, as described above. Therefore, as shown, in the single stringer 52 and in each of the braces 56, eleven folded panels define a trapezoidal cross-section conforming to the trapezoidal cross-section of the improved stringer illustrated and described in the copending patent application noted above, U.S. patent application Ser. No. 08/038,001, with certain panels secured adhesively to other panels.

Because of its trapezoidal cross-section, the stringer 52 has a relatively wide, substantially planar, upper edge 58 and a relatively narrow, substantially planar, lower edge 60. Because of its inverted, trapezoidal cross-section, each of the braces 56 has a relatively narrow, substantially planar, upper edge 62 and a relatively wide, substantially planar, lower edge 64. The upper edge 58 of the stringer 52 and the upper edges 62 of the braces 56 are substantially coplanar. The lower edges 60 of the stringer 52 and the lower edges 64 of the braces 56 are substantially coplanar.

Each of the notches of the single stringer 52 is similar to the notch 26 of the middle stringer 12, as described above, flares downwardly, and conforms to and receives a lower portion of one of the braces 56. The notch of each of the braces 56 is similar to the notch 28 of one brace 16, as described above, flares upwardly, and conforms to and receives an upper portion of the single stringer 52. The notches, which interengage with each other at each of the braces 56, are dimensioned so that the single stringer 52 and the braces 56 are substantially coplanar at their upper edges 58, 62, and at their lower edges 60, 64. The single stringer 52 is secured adhesively to the braces 56 at the interengaging notches.

As shown in FIG. 2, the pallet 50 further comprises two substantially planar sheets made from paperboard material, namely an upper sheet 70 having two side flaps 72 folded downwardly and a lower sheet 74 having two side flaps 76 folded upwardly. The side flaps 72 and the side flaps 76 overlap at each of two opposite sides of the pallet. The upper sheet 70 is secured adhesively to the upper edges 58 of the stringer 52 and to the upper edges 72 of the braces 56. The side flaps 72 of the upper sheet 70 are secured adhesively to the side flaps 76 of the lower sheet 74, whereby the upper sheet 70 and the lower sheet 74 are secured adhesively to each other where the side flaps 72, 76, overlap.

In the pallet 50, the braces 56 are spaced at their opposite ends 78 substantially from the side flaps 76 of the lower sheet 74 so as not to interfere with fork lift blades (not shown) entering the pallet 50 from either longitudinal direction.

The material used for the stringers 12, 14, and the braces 16 of the pallet 10, as described above, may be also used for the single stringer 52 and the braces 56. The material used for the sheets 40, 44, of the pallet 10, as described above, may be also used for the sheets 74, 76.

Figure 3:
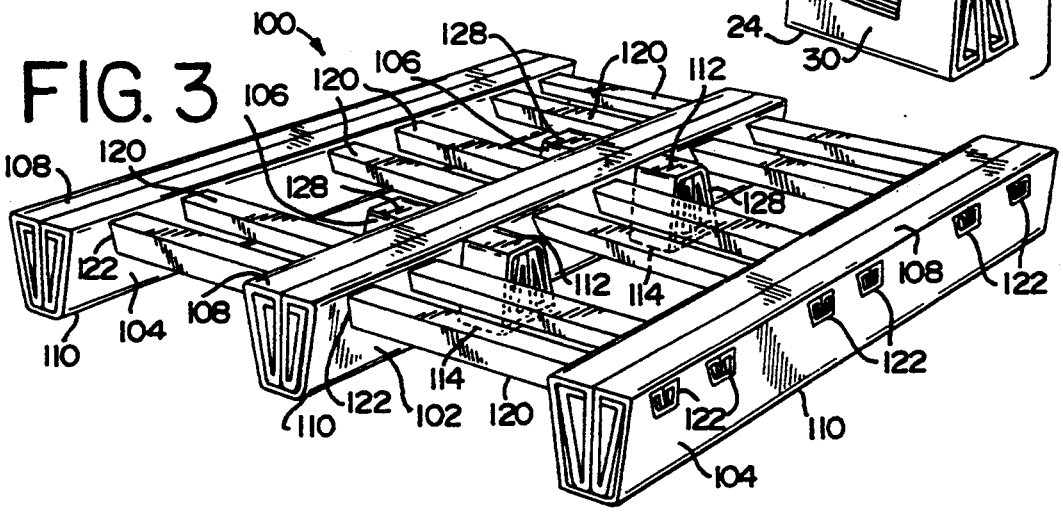
FIG. 3 is a perspective view of a pallet constituting a third embodiment of this invention.

As shown in FIG. 3, a pallet 100 made predominantly of corrugated paperboard constitutes a third embodiment of this invention. The pallet 100 comprises three relatively long, longitudinally extending stringers, namely a middle stringer 102 and two outer stringers 104. The pallet 100 further comprises two relatively short, transversely extending braces 106. The middle stringer 102 has two notches, each interengaging with a notch in a respective one of the braces 106 so as to assemble the middle stringer 102 and the braces 106. The notches in the middle stringer 102 and in the braces 106 are dimensioned so that the middle stringer 102 and the braces 106 are substantially coplanar at their upper and lower edges.

Each of the stringers 102, 104, is made from a folded piece of corrugated paperboard of a trapezoidal cross-section. Each of the braces 106 is made from a folded piece of corrugated paperboard of a trapezoidal cross-section, which is substantially identical to the cross-section of each of the stringers 102, 104, but which is inverted.

Preferably, the middle stringer 102, the outer stringers 104, and the braces 106 are substantially identical to the middle stringer 12, the outer stringers 14, and the braces 16 of the pallet 10, as described above. Therefore, as shown, in each of the stringers 102, 104, and in each of the braces 106, eleven folded panels define a trapezoidal cross-section conforming to the trapezoidal cross-section of the improved stringer illustrated and described in the copending patent application noted above, U.S. patent application Ser. No. 08/038,001, with certain panels secured adhesively to other panels.

Because of its trapezoidal cross-section, each of the stringers 102, 104, has a relatively wide, substantially planar, upper edge 108 and a relatively narrow, substantially planar, lower edge 110. Because of its inverted, trapezoidal cross-section, each of the braces 106 has a relatively narrow, substantially planar, upper edge 112 and a relatively wide, substantially planar, lower edge 114. The upper edges 108 of the stringers 102, 104, and the upper edges 112 of the braces 106 are substantially coplanar. The lower edges 110 of the stringers 102, 104, and the lower edges 114 of the braces 106 are substantially coplanar.

Each of the notches of the middle stringer 102 is similar to the notch 26 of the middle stringer 12, as described above, flares downwardly, and conforms to and receives a lower portion of one of the braces 106. The notch of each of the braces 106 is similar to the notch 28 of one brace 16, as described above, flares upwardly, and conforms to and receives an upper portion of the middle stringer 102. The notches, which interengage with each other at each of the braces 106, are dimensioned so that the middle stringer 102 and the braces 106 are substantially coplanar at their upper edges 108, 112, and at their lower edges 110, 114. The middle stringer 102 is secured adhesively to the braces 106 at the interengaging notches.

The pallet 100 further comprises six decking members 120, which extend transversely through apertures 122 in the stringers 102, 104. The decking members 120 are secured adhesively to the stringers 102, 104, at margins of the apertures 122. Each decking member 120 is folded from a single sheet of paperboard material, such as the material used for the stringers 102, 104, so as to have multiple panels, some of which panels are secured adhesively to other panels of such decking member 120. Each decking member 120 is similar to the decking members disclosed in Schmidtke U.S. Pat. No. 4,792,325, the disclosure of which is incorporated herein by reference.

As shown in FIG. 3, each of the braces 106 is located between a middle pair of the decking members 120 and an outer pair of the decking members 120. Alternatively, each of the braces 106 may be located between an outer one of the decking members 120 and a middle group of four decking members 120. Alternative arrangements employing different numbers of decking members similar to the decking members 120.

Passing through the apertures 122 in the stringers 102, 104, the decking members 120 necessarily pass beneath upper panels of the stringers 102, 104. Therefore, the upper edges of the decking members 120 are stepped downwardly from and are not regarded as substantially coplanar with the upper edges 108 of the stringers 102, 104, and the upper edges 112 of the braces 106 when the pallet 100 is oriented as shown.

In the pallet 100, the braces 106 are spaced at their opposite ends 128 substantially from the outer stringers 104 so as not to interfere with fork lift blades (not shown) passing between the outer stringers 104, beneath the decking members 120, from either longitudinal direction when the pallet 100 is oriented as shown.

The pallet 100 offers a particular advantage, which is evinced when the pallet 100 is placed onto a roller conveyor (not shown) having its rollers parallel to the stringers 102, 104. Because the braces 106 extend across the rollers, there is minimal risk that any of the stringers 102, 104, will drop between the rollers, even if a heavy load (not shown) is borne by the pallet 100.

In each of the several embodiments described above, the braces associated with the middle or single stringer provide the pallet with excellent lateral stability and load-carrying capacity. It is contemplated that braces like the braces described above may be advantageously made by cutting a stringer like one of the outer stringers noted above, without apertures for decking members, into several pieces of suitable lengths. Since there is no need to employ tubular reinforcing members as disclosed in Smith U.S. Pat. No. 5,001,991, meaningful savings in material costs may be achievable because of this invention.

Where adhesive securement is employed in any of the several embodiments described above, a so-called "cold melt" or "cold set" adhesive is suitable, such as Code No. 3715 or Code No. 3715B, both of which are available commercially from H. B. Fuller Co. of Palatine, Ill.

Herein, directional terms including "upper" and "lower" refer to the several embodiments described above in their preferred orientations, in which they are shown. At least the first and second embodiments described above would be also useful in an inverted orientation. The third embodiment noted above might be also used in an inverted orientation if the decking members were not needed to provide support beneath a load. Usage of such directional terms is not intended to restrict this invention to the preferred orientation.

In an alternative embodiment (not shown) contemplated by this invention, a pallet is similar to either of the first and third embodiments described above except that the pallet has four stringers, namely two outer stringers and two middle stringers. The middle stringers have two or more common braces spaced from each other along the middle stringers. Each of the common braces has two notches, each interfitting with a notch in one of the middle stringers.

In another alternative embodiment (not shown) contemplated by this invention, a pallet is similar to either of the first and third embodiments described above, except that each of the outer stringers has two or more spaced braces. The spaced braces are assembled to the outer stringers as the spaced braces are assembled to the middle stringers in the first and third embodiments described above. Preferably, the spaced braces are shortened at their outer ends so as not to extend by any substantial distance, if at all, beyond the outer walls of the outer stringers.

Various other modifications may be made in any of the several embodiments described above without departing from the scope and spirit of this invention.

We claim:

1. A generally rectangular pallet having a length and a width and comprising at least one longitudinally extending stringer folded from a single sheet of paperboard material of a given cross-section and at least one transversely extending brace folded from a single sheet of paperboard material of a similar cross-section, the stringer having a length corresponding generally to the length of the pallet, the stringer having an upper edge and a lower edge, the brace having an upper edge and a lower edge, the stringer having a notch receiving a portion of the brace, the brace having a notch receiving a portion of the stringer, the notches interengaging with each other and being dimensioned so that the stringer and the brace are substantially coplanar at their upper and lower edges, wherein the stringer is relatively long, as compared to the brace, and wherein the brace is relatively short, as compared to the width of the pallet.

2. The pallet of claim 1 wherein the stringer and the brace are secured adhesively to each other at the interengaging notches.

3. The pallet of claim 1 wherein the stringer and the brace have tapered cross-sections.

4. A pallet comprising at least one longitudinally extending stringer folded from a single sheet of paperboard material of a given cross-section and at least one transversely extending brace folded from a single sheet of paperboard material of a similar cross-section, the stringer having an upper edge and a lower edge, the brace having an upper edge and a lower edge, the stringer having a notch receiving a portion of the brace, the brace having a notch receiving a portion of the stringer, the notches interengaging with each other and being dimensioned so that the stringer and the brace are substantially coplanar at their upper and lower edges, wherein the stringer has a trapezoidal cross-section and the brace has a substantially identical but inverted, trapezoidal cross-section.

5. The pallet of claim 1 wherein the brace is one of two similar braces spaced from each other along the stringer.

6. The pallet of claim 1 wherein the brace is one of two similar braces located near opposite ends of the stringer.

7. The pallet of claim 1 wherein the stringer having the notch receiving the portion of the brace is a middle stringer between two outer stringers, each outer stringer extending longitudinally, being folded from a single sheet of paperboard material of a similar cross-section, and having an upper edge and a lower edge, the brace having opposite ends spaced from the outer stringers.

8. A pallet comprising at least one longitudinally extending stringer folded from a single sheet of paperboard material of a given cross-section and at least one transversely, extending brace folded from a single sheet of paperboard material of a similar cross-section, the stringer having a length corresponding generally to the length of the pallet, the stringer having an upper edge and a lower edge, the brace having an upper edge and a lower edge, the stringer having a notch receiving a portion of the brace, the brace having a notch receiving a portion of the stringer, the notches interengaging with each other and being dimensioned so that the stringer and the brace are substantially coplanar at their upper and lower edges, wherein the stringer having the notch receiving the portion of the brace is a middle stringer between two outer stringers, each outer stringer extending longitudinally, being folded from a single sheet of paperboard material of a similar cross-section, and having an upper edge and a lower edge, the brace having opposite ends spaced from the outer stringers, and wherein the pallet further comprises a plurality of decking members extending transversely through apertures in the outer and middle stringers.

9. A pallet comprising at least one longitudinally extending stringer folded from a single sheet of paperboard material of a given cross-section and at least one transversely extending brace folded from a single sheet of paperboard material of a similar cross-section, the stringer having a length corresponding generally to the length of the pallet, the stringer having an upper edge and a lower edge, the brace having an upper edge and a lower edge, the stringer having a notch receiving a portion of the brace, the brace having a notch receiving a portion of the stringer, the notches interengaging with each other and being dimensioned so that the stringer and the brace are substantially coplanar at their upper and lower edges, wherein the stringer having the notch receiving the portion of the brace is a middle stringer between two outer stringers, each outer stringer extending longitudinally, being folded from a single sheet of paperboard material of a similar cross-section, and having an upper edge and a lower edge, the brace having opposite ends spaced from the outer stringers, and wherein the pallet further comprises an upper sheet secured adhesively to the upper edges of the outer and middle stringers and a lower sheet secured adhesively to the lower edges of the outer and middle stringers.

10. The pallet of claim 9 wherein the upper sheet is secured adhesively to the upper edge of the brace and the lower sheet is secured adhesively to the lower edge of the brace.

11. The pallet of claim 10 wherein the middle stringer and the brace are secured adhesively to each other at the interengaging notches.

12. The pallet of claim 11 wherein the brace is one of two similar braces located near opposite ends of the middle stringer.

13. The pallet of claim 12 wherein the middle and outer stringers have substantially identical, trapezoidal cross-sections and the brace has a trapezoidal cross-section substantially identical to the cross-sections of the middle and outer stringers but inverted.

14. The pallet of claim 8 comprising exactly three stringers, namely the middle stringer and the outer stringers.

15. The pallet of claim 1 further comprising an upper sheet secured adhesively to the upper edge of the stringer and a lower sheet secured adhesively to the lower edge of the stringer.

16. The pallet of claim 15 wherein the upper sheet covers the upper edge of the brace and has two side flaps folded downwardly and the lower sheet covers the lower edge of the brace and has two side flaps folded upwardly, the side flaps of the upper and lower sheets overlapping at each side of the pallet, the upper sheet and the lower sheet being secured adhesively to each other where the side flaps overlap, the brace having opposite ends spaced from the overlapping side flaps.

17. The pallet of claim 16 wherein the brace is one of two similar braces located near opposite ends of the middle stringer.

18. A pallet comprising at least one longitudinally extending stringer folded from a single sheet of paperboard material of a given cross-section and at least one transversely extending brace folded from a single sheet of paperboard material of a similar cross-section, the stringer having a length corresponding generally to the length of the pallet, the stringer having an upper edge and a lower edge the brace having an upper edge and a lower edge, the stringer having a notch receiving a portion of the brace, the brace having a notch receiving a portion of the stringer, the notches interengaging with each other and being dimensioned so that the stringer and the brace are substantially coplanar at their upper end lower edges, wherein the pallet further comprises an upper sheet secured adhesively to the upper edge of the stringer and a lower sheet secured adhesively to the lower edge of the stringer, wherein the upper sheet covers the upper edge of the brace and has two side flaps folded downwardly and the lower sheet covers the lower edge of the brace and has two side flaps folded upwardly, the side flaps of the upper and lower sheets overlapping at each side of the pallet, the upper sheet and the lower sheet being secured adhesively to each other where the side flaps overlap, the brace having opposite ends spaced from the overlapping side flaps, wherein the brace is one of two similar braces located near opposite ends of the middle stringer, wherein the middle and outer stringers have substantially identical, trapezoidal cross-sections and the braces have trapezoidal cross-sections substantially identical to the cross-sections of the middle and outer stringers but inverted.

* * * * *

UNITED STATES PATENT AND TRADEMARK OFFICE

CERTIFICATE OF CORRECTION

PATENT NO. : 5,370,061

DATED : December 6, 1994

INVENTOR(S) : Ted D. Kilpatrick and Arthur M. Wagner

It is certified that error appears in the above-indentified patent and that said Letters Patent is hereby corrected as shown below:

Col. 2, line 5, "notch" should be --stringer--.

Col. 10, line 24, "end" should be --and--.

Signed and Sealed this

Eighth Day of August, 1995

*Attest:*

Bruce Lehman

BRUCE LEHMAN

*Attesting Officer*

*Commissioner of Patents and Trademarks*